US007052246B1

(12) United States Patent
Ploug et al.

(10) Patent No.: US 7,052,246 B1
(45) Date of Patent: May 30, 2006

(54) AXIAL PISTON MICROPUMP

(75) Inventors: Ole Ploug, Struer (DK); Jakob Bøgh Schubert, Herlev (DK); Christian Peter Enggaard, Sydals (DK)

(73) Assignee: Danfoss A/S, Nordborg (DK)

( * ) Notice: Subject to any disclaimer, the term of this patent is extended or adjusted under 35 U.S.C. 154(b) by 0 days.

(21) Appl. No.: 09/000,008

(22) PCT Filed: Jul. 4, 1996

(86) PCT No.: PCT/DK96/00302

§ 371 (c)(1),
(2), (4) Date: Mar. 26, 1998

(87) PCT Pub. No.: WO97/04233

PCT Pub. Date: Feb. 6, 1997

(30) Foreign Application Priority Data

Jul. 15, 1995 (DE) ..... 195 25 852

(51) Int. Cl.
*F04B 1/12* (2006.01)
*F04B 27/08* (2006.01)

(52) U.S. Cl. ..... 417/269; 91/499; 92/12.2

(58) Field of Classification Search ..... 417/269, 417/270, 222.1; 91/499, 484, 485; 92/12.2, 92/71, 138

See application file for complete search history.

(56) References Cited

U.S. PATENT DOCUMENTS

| | | | | | |
|---|---|---|---|---|---|
| 3,046,906 | A | * | 7/1962 | Budzich | 91/487 |
| 3,075,472 | A | * | 1/1963 | Garnier | 91/506 |
| 3,479,963 | A | * | 11/1969 | Randa et al. | 91/485 |
| 3,657,970 | A | * | 4/1972 | Kobayashi et al. | 91/485 |
| 4,269,574 | A | * | 5/1981 | Bobier | 417/506 |
| 4,425,837 | A | | 1/1984 | Liversay | |
| 4,583,921 | A | * | 4/1986 | Wolff et al. | 417/269 |
| 4,815,358 | A | * | 3/1989 | Smith | 92/12.2 |
| 5,086,689 | A | * | 2/1992 | Masuda | 91/499 |

FOREIGN PATENT DOCUMENTS

| | | |
|---|---|---|
| DE | 353226 | 5/1922 |
| DE | 424897 | 2/1926 |

* cited by examiner

*Primary Examiner*—Justine R. Yu
*Assistant Examiner*—Han L Liu
(74) *Attorney, Agent, or Firm*—Barnes & Thornburg LLP

(57) ABSTRACT

An axial piston micropump is disclosed, having a cylinder drum, in which several cylinders are provided a swash plate, with respect to which the cylinder drum is rotatable. It is desirable for such a micropump to have a small displacement combined with a long service life and in which the displacement or delivery volume can be achieved with great accuracy. For that purpose, at least two cylinders are provided, of which at least one is in the form of a working cylinder which has an associated working piston, while at least one other cylinder is in the form of a balance cylinder and has an associated balance piston.

19 Claims, 4 Drawing Sheets

AXIAL PISTON MICROPUMP

BACKGROUND OF THE INVENTION

The invention relates to an axial piston micropump having a cylinder drum, in which several cylinders are provided, and a swash plate, with respect to which the cylinder drum is rotatable.

Many different constructions of axial piston pumps are known. An axial piston pump is disclosed, for example, in DE 37 28 448 A1.

For certain applications, it is desirable to have a pump of which the delivery volume or displacement is very small, but where the small delivery volume can be controlled or adhered to with great accuracy. This can be realised firstly by reducing the dimensions of the pump. Here, however, certain limits must be observed. If miniaturization is carried too far, it is impossible to keep to the desired accuracy of the displacement.

The route, obvious Per se, of providing the axial piston pump with just one cylinder must similarly be ruled out. In that construction a certain tilting moment acts on the swash plate and/or the bearing of the cylinder drum on every revolution of the cylinder drum, so that although when the pump is new the delivery volume can be adjusted with the desired accuracy, bearing play, which falsifies the delivery volume, very soon occurs in the course of operation on account of the loading; an additional complicating factor is that the error in the delivery volume is not recognizable straight away. Such a pump therefore has only a relatively short service life.

SUMMARY OF THE INVENTION

The invention is based on the problem of providing a micropump of the axial piston type which combines great accuracy with a small displacement and has a long service life.

That problem is solved in an axial piston micropump of the kind mentioned in the introduction in that at least two cylinders are provided, of which at least one is in the form of a working cylinder which has an associated working piston, whilst at least one other cylinder is in the form of a balance cylinder and has an associated balance piston.

With this construction the number of working cylinders can be reduced. The displacement or delivery rate is correspondingly reduced. Nevertheless, the loading of the cylinder drum can be kept substantially uniform. The balance cylinders with the balance pistons serve for that purpose. All pistons, that is, both the working pistons and the balance pistons, are supported on the swash plate by way of slide shoes. Since at least two cylinders are provided, there are therefore always at least two slide shoes on the swash plate. When more than two cylinders are provided, these slide shoes form the corner points of a triangle or polygon. The forces acting on the cylinder drum are thus always such that it cannot tilt under the action of an individual piston. The bearings are thus treated with care. The position with respect to the swash plate can be maintained exactly for a long period of time. Neither is the position of the swash plate changed by lopsidedly acting forces. Altogether, this therefore provides a micropump which does have a small delivery volume, because only few working cylinders contribute to the delivery, but nevertheless is able to maintain the set delivery volume exactly over a very long period of time.

Preferably, only one cylinder is in the form of a working cylinder. In that case the delivery rate or displacement is correspondingly small.

Preferably, the working piston is surrounded in the region of its end remote from the swash plate by a resilient ring, which is arranged between working piston and cylinder drum and follows movement of the working piston. This resilient ring thus seals the piston with respect to the cylinder. The risk that fluid that ought to be displaced by the compression movement of the working piston will flow past the piston through the cylinder is thus kept very small. This measure also improves the accuracy in adhering to the desired delivery volume. With a micropump, the movement of the working piston with respect to the cylinder is so small that the resilient ring is able to follow the movement of the working piston by deformation. Virtually no friction therefore develops between the working piston or the cylinder wall and the ring.

It is also especially preferred for the resilient ring to be arranged between cylinder drum and valve plate. The resilient ring therefore not only forms the seal around the working piston, but also seals the cylinder drum and the valve plate with respect to one another, so that no fluid is able to escape at this point.

In a preferred construction provision is also made for each cylinder to be surrounded in the region of its end face adjacent to the valve plate by a resilient ring which is arranged between cylinder drum and valve plate. The balance cylinders are therefore also sealed by means of a resilient ring, so that the resilient rings permit a small tilting movement of the valve plate with respect to the cylinder drum. In some cases it is necessary to allow such a tilting movement, because even in high-precision manufacturing certain tolerances have to be accepted.

Advantageously, the ring has a radially inner annular sealing flange and a radially outer annular supporting flange which is arranged substantially concentrically with respect to the sealing flange and is joined to this by way of an annular web of reduced thickness. A greater resilience of the ring is achieved by that measure. The sealing flange can remain in engagement with the piston and the supporting flange can remain in engagement with the cylinder. The web has a sort of hinge-function and allows movement of sealing flange and supporting flange relative to one another to a certain extent.

It is especially preferred in that case for the sealing flange to have a smaller thickness than the supporting flange. The supporting flange can then be supported with great reliability in the cylinder, whilst the sealing flange bears against the piston under a somewhat lower bias. This likewise facilitates the movement of the piston with respect to the sealing flange.

Preferably, the ring is located in a circumferential groove. In this manner the ring can be given a certain radial thickness so that it can be more readily deformed, and thus follows the movement of the working piston better.

It is also preferred for the cylinder drum to have a through bore for each cylinder and on the side remote from the swash plate to be connected, without relative rotation, to a valve plate which has an opening only for each working cylinder. This simplifies the manufacture of the cylinder drum. The creation of the bore, which later forms the cylinder, can be effected with extremely great accuracy.

It is especially preferred in that case for each working cylinder to have a working chamber in which the working piston and its end face move, the working chamber being formed in the valve plate. On the side facing the valve plate the working piston thus projects out of the cylinder drum again and into the valve plate, where the working chamber is formed. In the cylinder drum itself, the only measures that need to be taken are those to provide for the movement of the working piston, in particular, measures to support the working piston against tilting. Only in a relatively small section, namely in the valve plate, need attention be paid during manufacture to the great accuracy that is necessary for the adjustment of the desired delivery volume.

Preferably, the opening in the valve plate has a constant diameter over the thickness of the valve plate. The piston can then be extended, so that a very small working chamber is formed. This working chamber is then bounded only by the control plate unit. Virtually no, or only very small, dead volumes occur, so that even compressible media can be delivered with the necessary accuracy.

It is also preferred for the valve plate to bear against a control plate unit, which is arranged non-rotatably in a housing, the control plate unit being supported by way of an elastomeric bearing on the housing. This construction serves also to allow a tilting movement of the cylinder drum or the valve plate with respect to the housing. This tilting movement is of the order of magnitude only of a fraction of a degree, but without further precautions can have undesirable effects.

Advantageously, the valve plate and/or the control plate unit are made from ceramic material. This measure ensures that a good seal between the valve plate and the control plate unit is achieved; at the same time a relatively long service life can be ensured.

Advantageously, the cylinder drum is driven by a stepper motor. In this manner the delivery volume can be restricted even to fractions of the displacement per revolution. By means of the stepper motor, the movement of the cylinder drum can be very accurately controlled.

Preferably, the displacement per revolution is less than 10 μl. A very small delivery quantity is thus involved.

It is also preferred for the pistons to be provided with bias springs of substantially equal strength. The main forces, which act between the cylinder drum and the swash plate, are in that case absorbed by the bias springs. The additional forces, which are caused by the delivery of the fluid, are virtually of no consequence.

BRIEF DESCRIPTION OF THE DRAWINGS

The invention is described hereinafter with reference to preferred embodiments in conjunction with the drawings, in which.

DESCRIPTION OF THE PREFERRED EMBODIMENTS

Figure 1:
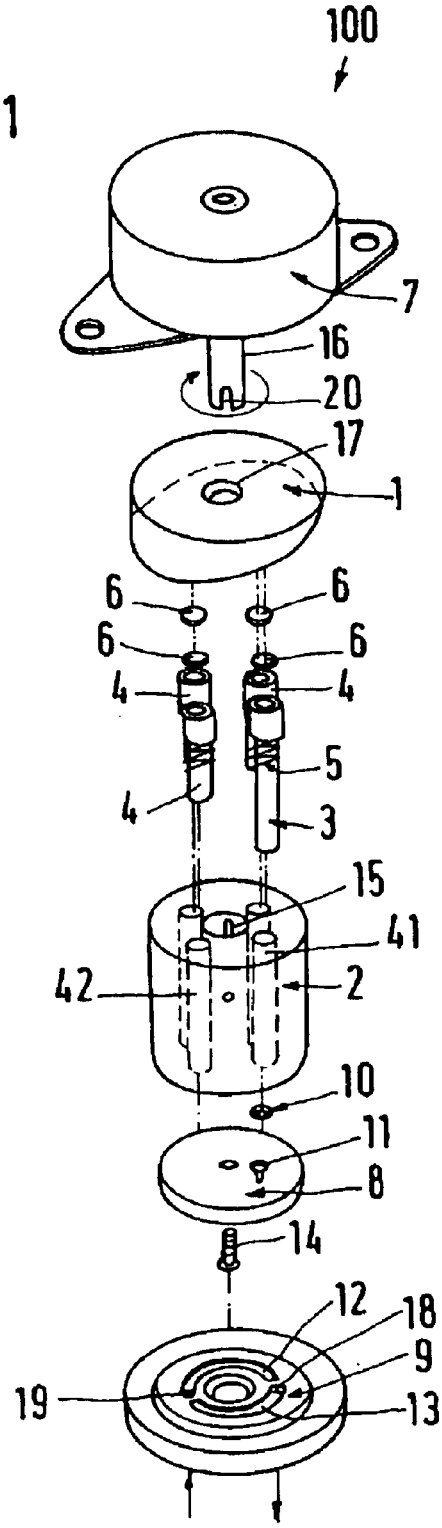
FIG. 1 is an exploded view of a first embodiment of a micropump.

A micropump 100, as used for accurate dosing of liquids or gases, for example, for dosing medicaments in the field of medicine or for dosing reagents in the field of chemistry, has a swash plate 1 and a cylinder drum 2 which can be rotated with respect to the swash plate 1. In the cylinder drum 2 there are provided at least two cylinders 41, 42, in this particular case indeed four cylinders, of which one cylinder is in the form of a working cylinder 41 and the remaining three cylinders are in the form of balance cylinders 42. A working piston 3 is arranged to move axially in the working cylinder 41. A balance piston 4 is arranged to move axially in each of the balance cylinders 42. All pistons 3, 4 are supported against the cylinder drum 2 by way of bias springs 5.

The pistons 3, 4 bear against the swash plate by means of slide shoes 6. When the cylinder drum 2 is rotated with respect to the swash plate 1 by means of a motor 7, which is in the form of a stepper motor, the pistons are set moving back and forth by the slope of the swash plate. This principle is generally well known from axial piston machines.

The stepper motor 7 has an axle 16 which passes through a central bore 17 in the swash plate 1. The axle 16 is provided with a slot 20 which engages with a tongue 15 in the cylinder drum 2 and thus effects a connection not permitting rotation between the axle 16 and the cylinder drum 2.

The working cylinder 41 and the balance cylinders 42 are in the form of through bores in the cylinder drum 2. At the end face of the cylinder drum 2 remote from the swash plate 1 the cylinder drum is therefore covered, in order to form the cylinders 41, 42, by a valve plate 8, which is secured to the cylinder drum 2 by means of a screw 14 and is non-rotatably connected to the cylinder drum by means not shown.

The valve plate 8 has an opening 11 only for the working cylinder 41, through which opening the fluid to a be delivered is able to escape from or enter the working cylinder 41.

To control the fluid in the pump, as is known from axial piston pumps, a control plate unit 9 is provided, which comprises two control "kidneys" 12, 13 of which one is connected to an inlet 18 and the other is connected to an outlet 19 of the pump. The control kidneys 12, 13 are oriented with respect to the swash plate 1 in such a manner that the control kidney connected to the inlet 18 is arranged where the working piston 3, controlled by the swash plate 1, performs an upward movement (in relation to the illustration in FIG. 1), whilst the control kidney connected to the outlet 19 is arranged where the working piston 3 performs a corresponding downward movement.

Figure 2:
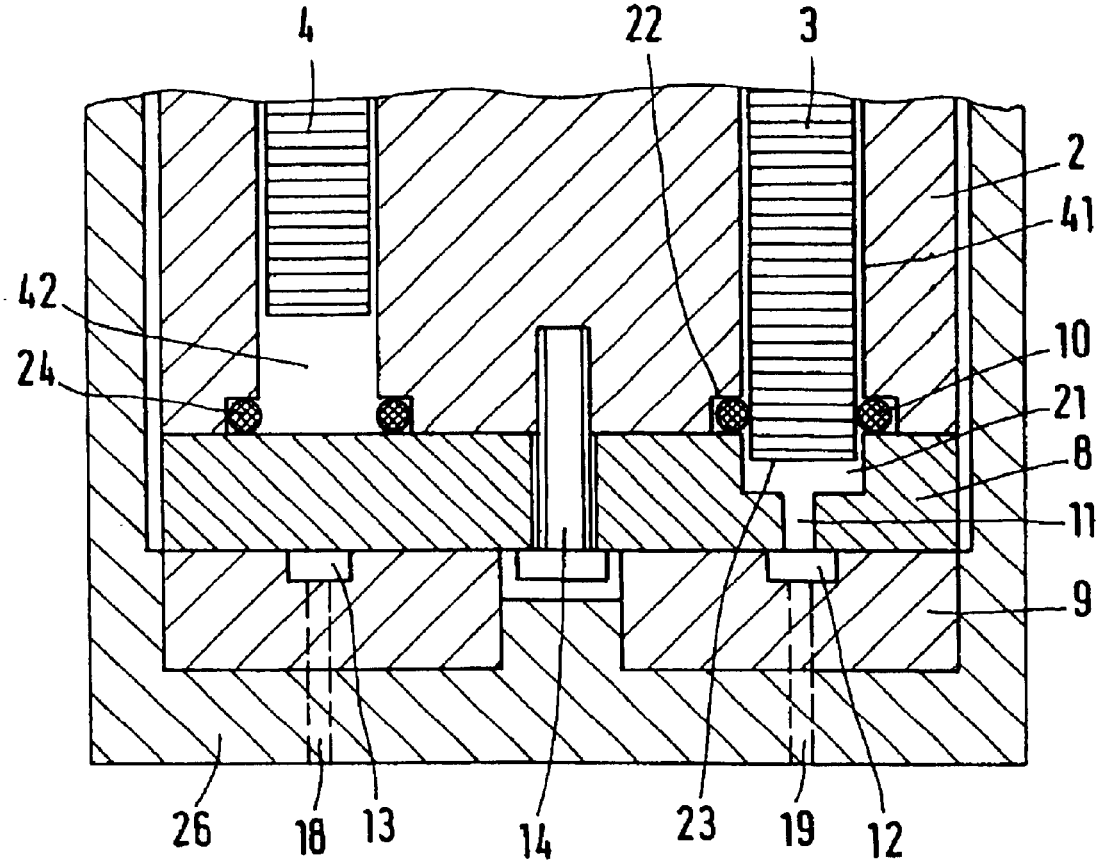
FIG. 2 is a section through the micropump shown in FIG. 1.

As is especially clear from FIG. 2, which shows a cross-section through a part of the pump, between the valve plate 8 and the cylinder drum 2 there is provided a resilient ring 10 which on the one hand seals the valve plate 8 with respect to the cylinder drum 2 and on the other hand also surrounds the working piston 3 annularly. The ring is here inserted in a circumferential groove 22. It lies against the working piston 3. When the working piston 3 performs its back and forth movement, the ring 10 is able to follow this movement by deforming. The movements of the working piston 3 are relatively small in the micropump 100. In this manner friction between the resilient ring 10 and the working piston 3 and friction between the cylinder drum 2 and the ring 10 are avoided.

Similarly, in the region of the end face of the balance cylinders 42, a respective resilient ring 24 is arranged between the valve plate 8 and the cylinder drum 2.

The seal obtained through use of the resilient rings 10, 24, which are, for example, O-rings, enables a small tilting movement of the cylinder drum 2 with respect to the control plate unit 9 to be allowed for. Such a tilting movement is virtually unavoidable on account of manufacturing tolerances. Although it is of the order or magnitude of only a fraction of a degree, it can lead to leakages if no counter-measures are taken. These counter-measures can be realized in a relatively simple manner by means of the resilient rings 10, 24.

As is especially clear from FIG. 2, the working piston 3 projects right through the cylinder drum 2. For that reason a working chamber 21, in which the end face 23 of the working piston 3 moves back and forth, is formed in the valve plate 8. With such a construction the cylinder drum has to be machined only accurately enough to ensure exact guidance of the working piston 3.

When the micropump 100 is now operated, the motor 7 is set in operation and rotates the cylinder drum through a desired angle. The motor 7 can, of course, rotate the cylinder drum 2 through a whole revolution or through several revolutions. During this rotary movement the slide shoes 6 slide over the swash plate 1. As they do so, the slide shoes 6 are pressed by the bias springs 5 against the swash plate 1. Thus, the pistons are always being pressed out of the cylinder drum 2. At its thickest part the swash plate presses the pistons 3, 4 back into the cylinder drum 2 again. Since the bias springs 5 are all substantially the same, this produces four substantially similar force application points on the cylinder drum 2 which are distributed evenly around its midpoint, that is, around its axis of rotation. Tilting of the cylinder drum 2 in its bearings is reliably avoided for that reason.

The forces are determined substantially by the bias springs 5. Of course, the fluid to be delivered also contributes a little to the forces acting on the swash plate 1.

Figure 3:
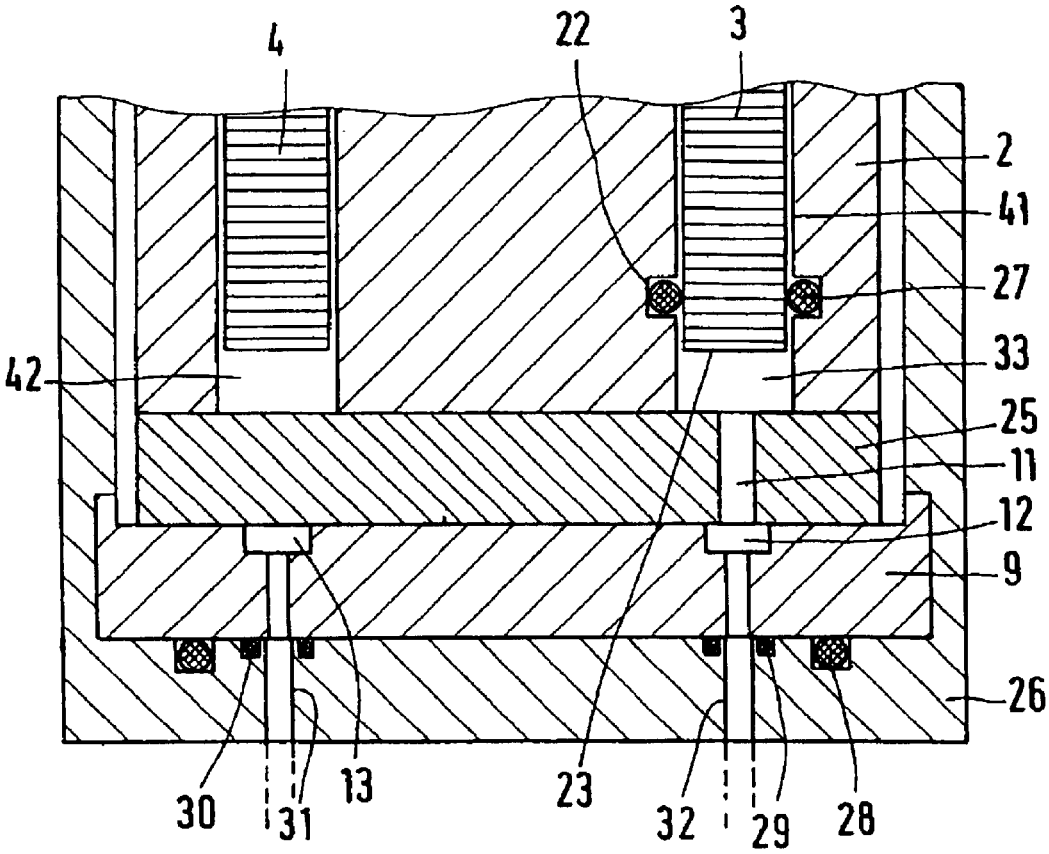
FIG. 3 is a section through a different embodiment of a micropump.

FIG. 3 shows a further embodiment of a micropump in which identical parts have been provided with the same reference numerals.

The construction differs from that according to FIGS. 1 and 2 in that the valve plate 25 is of substantially simpler construction. No working chamber is provided. On the contrary, the bore 11 passes right through the valve plate 25 without changing its diameter. Accordingly, the working chamber is now formed in the cylinder drum 2. Here too, the working chamber 21 is sealed by a resilient ring 27 which is located in a circumferential groove 22 in the cylinder drum 2.

The valve plate 25 can be adhesively secured to the cylinder drum 2, so that a fixed connection is ensured here.

In order nevertheless to allow a small tilting movement of the cylinder drum 2, the control plate unit 9 is supported on the housing 26 by way of a resilient ring 28. This necessitates a seal between the control plate unit 9 and the channels 31, 32 in the housing, which can likewise be ensured by resilient rings 29, 30 or other forms of sealing.

Figure 4:
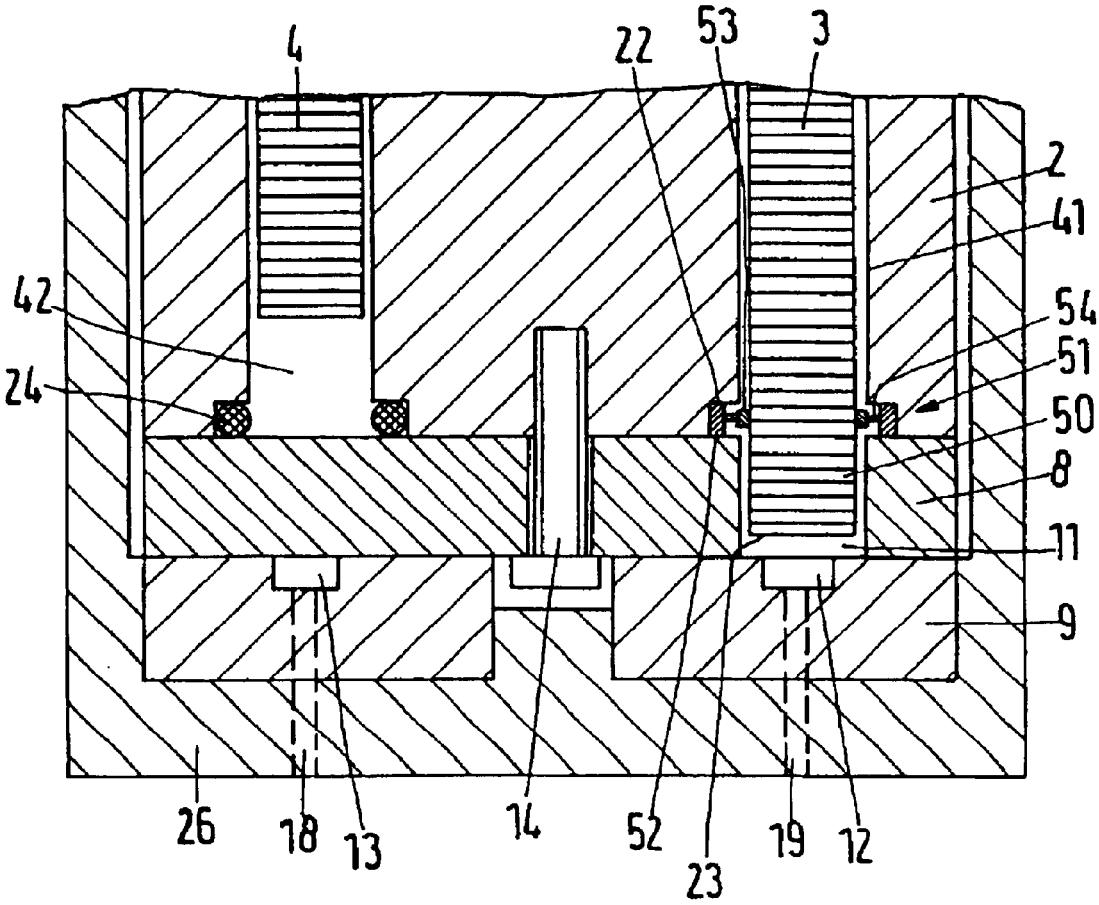
FIG. 4 is a section through a third embodiment of a micropump.

FIG. 4 shows a third embodiment, which corresponds substantially to that of FIG. 2. But unlike that configuration, the bore 11 is continuous, that is, is provided with the same diameter over the entire thickness of the valve plate 8. The piston 3 has an extension 50, which is introduced further into the opening 11. Accordingly, only a very small working chamber is formed, which opens directly towards the control plate unit 9. The dead volume which cannot be displaced by the piston 3 is consequently extremely small.

A different sealing ring 51 is shown in FIG. 4 as a further modification. The sealing ring 51 is likewise arranged in the groove 22. It has a radially outer supporting flange 52 and a radially inner supporting flange 53 which are connected to one another by a web 54. The web 54 has the function of a hinge. It is substantially thinner than the supporting flange 52 or the sealing flange 53. The sealing flange 53 also has a smaller thickness than the supporting flange 52. Supporting flange 52, sealing flange 53 and web 54 are arranged concentrically with respect to one another and also surround the piston concentrically. The piston is therefore able to make small back and forth movements, without the seal between the piston 3 and the cylinder drum 2 suffering. The sealing flange 53 remains in that case clinging to the piston 3, whilst the supporting flange 52 remains stationary in the groove 22. The web 54 permits these small movements, without the seal being disturbed in any way.

What is claimed is:

1. Axial piston micropump comprising a cylinder drum, a plurality of cylinders, and a swash plate, the swash plate being rotatable with respect to the cylinder drum, at least one of the cylinders comprising a working cylinder having an associated working piston, and at least one other of the cylinders comprising a balance cylinder having an associated balance piston, each said balance cylinder being located in said cylinder drum.

2. Axial piston micropump according to claim 1, in which only one cylinder is a working cylinder.

3. Axial piston micropump according to claim 1, in which the working piston is surrounded proximate an end remote from the swash plate by a resilient ring located between the working piston and the cylinder drum.

4. Axial piston micropump according to claim 3, in which the ring has a radially inner annular sealing flange and a radially outer annular supporting flange substantially concentric with respect to the inner annular sealing flange, the flanges being joined by an annular web of reduced thickness.

5. Axial piston micropump according to claim 4, in which the sealing flange has a smaller thickness than the supporting flange.

6. Axial piston micropump according to claim 3, in which the ring is located in a circumferential groove.

7. Axial piston micropump according to claim 3, in which the resilient ring is located between cylinder drum and valve plate.

8. Axial piston micropump according to claim 7, in which the ring has a radially inner annular sealing flange and a radially outer annular supporting flange substantially concentric with respect to the inner annular sealing flange, the flanges being joined by an annular web of reduced thickness.

9. Axial piston micropump according to claim 8, in which the sealing flange has a smaller thickness than the supporting flange.

10. Axial piston micropump according to claim 7, in which the ring is located in a circumferential groove.

11. Axial piston micropump according to claim 1, in which each cylinder is surrounded proximate an end face adjacent to the valve plate by a resilient ring located between the cylinder drum and the valve plate.

12. Axial piston micropump according to claim 1, in which the cylinder drum has a through bore for each cylinder and is connected without permitting relative rotation on a side remote from the swash plate to a valve plate having an opening only for each working cylinder.

13. Axial piston micropump according to claim 12, in which each working cylinder has a working chamber in which the working piston and its end face move, the working chamber being formed in the valve plate.

14. Axial piston micropump according to claim 12, in which the opening in the valve plate has a constant diameter over the thickness of the valve plate.

15. Axial piston micropump according to claim 1, in which the valve plate bears against a control plate unit which is non-rotatably located in a housing, the control plate unit being supported on the housing by a resilient bearing.

16. Axial piston micropump according to claim 1, in which at least one of the valve plate and the control plate unit is made from ceramic material.

17. Axial piston micropump according to claim 1 in which the cylinder drum is driven by a stepper motor.

18. Axial piston micropump according to claim 1, having a displacement per revolution less than 10 μl.

19. Axial piston micropump according to claim 1, in which the pistons have bias springs of substantially equal strength.

* * * * *